US009206804B2

(12) United States Patent
Tsubai et al.

(10) Patent No.: US 9,206,804 B2
(45) Date of Patent: Dec. 8, 2015

(54) COMPRESSOR FOR VEHICLE WITH REDUCED VIBRATIONS

(71) Applicant: KABUSHIKI KAISHA TOYOTA JIDOSHOKKI, Kariya-shi, Aichi-ken (JP)

(72) Inventors: Shinji Tsubai, Kariya (JP); Ken Suitou, Kariya (JP); Hiroyuki Gennami, Kariya (JP); Hideo Kanai, Kariya (JP); Kazuhiro Kuroki, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 267 days.

(21) Appl. No.: 13/679,326

(22) Filed: Nov. 16, 2012

(65) Prior Publication Data

US 2013/0129551 A1 May 23, 2013

(30) Foreign Application Priority Data

Nov. 18, 2011 (JP) ..... 2011-252814

(51) Int. Cl.
*F04C 18/02* (2006.01)
*F04C 23/00* (2006.01)
*F04C 29/06* (2006.01)

(52) U.S. Cl.
CPC ..... *F04C 18/02* (2013.01); *F04C 18/0215* (2013.01); *F04C 23/008* (2013.01); *F04C 29/06* (2013.01); *F04C 2240/52* (2013.01); *F04C 2240/60* (2013.01); *F04C 2270/12* (2013.01)

(58) Field of Classification Search
CPC ..... F04C 2240/52; F04C 2240/60; F04C 2270/12
USPC ..... 418/55.1
See application file for complete search history.

(56) References Cited

U.S. PATENT DOCUMENTS 4,480,881 A 11/1984 Fujimori
4,764,096 A 8/1988 Sawai et al.

(Continued)

FOREIGN PATENT DOCUMENTS

CN 87103909 A 12/1987
CN 1113549 A 12/1995

(Continued)

OTHER PUBLICATIONS

Communication dated Dec. 15, 2014, issued by the State Intellectual Property Office of the People's Republic of China in counterpart Application No. 201210466582.3.

(Continued)

*Primary Examiner* — Mary A Davis
(74) *Attorney, Agent, or Firm* — Sughrue Mion, PLLC

(57) ABSTRACT

With regard to a scroll compressor, a compression portion is rotatably connected with one end portion of a rotating shaft. A first shaft portion formed at one end portion of the rotating shaft is supported through a first bearing by a partition. A second shaft portion formed at the other end portion of the rotating shaft is supported through a second bearing by a cylindrical shaft support. A coil spring is interposed between a second inner race of a second bearing and a spring receiving portion of the rotating shaft which faces the second inner race in the shaft direction of the rotating shaft. The structure reduces vibration toward the shaft length direction of the rotating shaft and minimizes common vibrations together with vehicle side vibrations.

6 Claims, 4 Drawing Sheets

(56) References Cited

U.S. PATENT DOCUMENTS

| | | | | |
|---|---|---|---|---|
| 4,946,353 | A * | 8/1990 | Crofoot | 418/55.5 |
| 5,166,566 | A | 11/1992 | Bernhardt et al. | |
| 5,213,489 | A | 5/1993 | Kawahara et al. | |
| 5,489,198 | A | 2/1996 | Comparin et al. | |
| 5,593,294 | A * | 1/1997 | Houghtby et al. | 418/55.1 |
| 6,371,739 | B1 * | 4/2002 | Aiba | 417/410.5 |
| 6,887,051 | B2 * | 5/2005 | Sakuda et al. | 418/55.5 |
| 7,828,536 | B2 | 11/2010 | Van Leuven | |
| 8,844,317 | B2 * | 9/2014 | Park et al. | 62/498 |
| 2006/0177333 | A1 * | 8/2006 | Sakuda et al. | 418/55.3 |
| 2008/0044300 | A1 * | 2/2008 | Sakuda et al. | 417/410.3 |
| 2013/0089419 | A1 * | 4/2013 | Collie et al. | 415/229 |

FOREIGN PATENT DOCUMENTS

| | | | |
|---|---|---|---|
| CN | 101248277 | A | 8/2008 |
| JP | 62-150094 | A | 7/1987 |
| JP | 03-149381 | A | 6/1991 |
| JP | 05-133353 | A | 5/1993 |
| JP | 07-027073 | A | 1/1995 |
| JP | 07-279841 | A | 10/1995 |
| JP | 09-004696 | A | 1/1997 |
| JP | 09-119386 | A | 5/1997 |
| JP | H11332165 | A | 11/1999 |
| JP | 2002-257057 | A | 9/2002 |
| JP | 2003-202018 | A | 7/2003 |
| JP | 2004-124906 | A | 4/2004 |
| JP | 2010-159740 | A | 7/2010 |

OTHER PUBLICATIONS

Communication dated Jul. 16, 2015 from the State Intellectual Property Office of the People's Republic of China in counterpart application No. 201210466582.3.

* cited by examiner

COMPRESSOR FOR VEHICLE WITH REDUCED VIBRATIONS

BACKGROUND OF THE INVENTION

The present invention relates to a compressor for vehicle comprising a compression portion driven by rotating a rotary shaft.

One kind of the compressor for vehicle is a scroll compressor, for example. The scroll compressor has a fixed scroll and a movable scroll. The fixed scroll and the movable scroll mesh each other. In the compressor, one end of the rotary shaft is connected to the movable scroll. In the compression portion, by turning the rotary shaft, refrigerant is compressed by rotating the movable scroll around the fixed scroll. In addition, both end portions of the rotary shaft are rotatably supported by a bearing in the housing.

In case of such the scroll compressors, when a stress in the compression portion, for example compression reaction force, occurs in the rotary shaft direction, a vibration is transferred along the rotary shaft direction. If the vibration is in resonance with a vehicle side vibration, the produced noise becomes bigger. The Japanese Unexamined Patent Application Publication No. 3-149381 discloses a technology to reduce the noise. In FIG. 4, a main bearing (not shown) is supported in a main bearing member (not shown) formed in a closed container 90 (housing). A sub bearing 92 is supported in a sub bearing portion 91. One end portion of a main shaft (not shown) in a crankshaft 93 (rotary shaft) is rotatably supported, and the other end portion of the main shaft is rotatably supported by the sub bearing 92. The crankshaft 93 is integrally rotatably connected to a rotor 94 of a motor.

Additionally, the other portion of the crankshaft 93 is formed slimmer than a connection portion connected to the rotor 94. A stepped portion 93A is formed in the crankshaft 93 with a different diameter of the crankshaft 93. A wave-shaped washer 95 is located between the stepped portion 93A and the end face of an inner race 92A of the sub bearing 92.

By the wave-shaped washer 95, an elastic force is provided toward the direction of the crankshaft 93. The elastic force of the wave-shaped washer 95 performs as a preload to the inner race 92A. Therefore, the vibration of the crankshaft 93 is reduced by the preload of the wave-shaped washer 95. As a result, a noise caused by resonance is reduced.

However, the Japanese Unexamined Patent Application Publication No. 3-149381 leaves room for a further improvement to reduce common vibrations by reducing the vibration of the crankshaft 93 by the wave-shaped washer 95.

The compressor for vehicle of the invention provides a feature by which the vibration toward the direction of the rotary shaft is suppressed and vibration in accordance with the vehicle side vibration source is controllable to reduce resonance.

SUMMARY OF THE INVENTION

The object is solved by the features of claim 1.

In accordance with the present invention, a compressor for vehicle includes a compression portion driven by a rotary shaft in a housing. The compression portion is located in the housing. A rotary shaft is connected with the compression portion at one end. A motor drives the compression portion through the rotary shaft. A first shaft portion and a second shaft portion are formed at both ends of the rotary shaft. The first shaft portion is formed between the compression portion and the motor, and is supported by a first bearing. The second shaft portion is formed between the motor and the housing, and is supported by a second bearing. A coil spring is installed between either one of the first bearing or the second bearing and either one of the rotary shaft or the housing opposing one of the bearings in the axial direction of the rotary shaft.

The advantage is that a preload is provided to the rotary shaft through either the first bearing or the second bearing, and the rotary shaft remains preloaded in the axial direction by the coil spring. Therefore, even if a vibration occurred in the compression portion and is transferred in the axial direction along the rotary shaft, the vibration of the rotary shaft is reduced by the load of the coil spring. Additionally, the controllable range of the amount of expansion and contraction of the coil spring or the amount of spring load is bigger. By controlling the range of the amount of expansion and contraction of the coil spring or the amount of spring load, even if the rotary shaft vibrates in the axial direction, a peak of frequency can be shifted. When the peak is displaced from a peak of frequency of the vehicle side vibration, common vibrations are controlled and resonance is avoided.

In accordance with the present invention, the coil spring may be wound around the second shaft portion. The rotary shaft may form a spring supporting portion and the diameter of which may be greater than that of the second shaft portion. The second bearing may include an inner race. The coil spring may be installed between the inner race of the second bearing and the spring support portion of the rotary shaft. The second shaft portion may be relatively movable against the inner race of the second bearing.

The advantage is that the vibration of the rotary shaft and common vibrations are controllable.

In accordance with the present invention, the housing may form a spring supporting portion. The second bearing may include an outer race. The coil spring may be installed between the spring supporting portion of the housing and an outer race of the second bearing. The outer race of the second bearing is relatively movable with respect to the spring supporting portion of the housing in the axial direction.

The advantage is that the vibration of the rotary shaft and common vibrations are controllable.

In accordance with the present invention, a protruding portion may be formed between one of the bearings and the spring support portion. The protruding portion may engage with the coil spring.

The advantage is that the coil spring is prevented from dropping out from the rotary shaft by being engaged with the protruding portion at one end of the coil spring. Therefore, during assembly of the scroll compressor, when the rotary shaft with the coil spring is moved, the coil spring is prevented from dropping out from the rotary shaft.

In accordance with the present invention, the coil spring may be installed in a compressed state.

The advantage is that the preload is provided to the rotary shaft through either the first bearing or the second bearing by the return power from the compressed state of the coil spring, and the rotary shaft remains loaded.

In accordance with the present invention, the compression portion may be a scroll-type.

The advantage is that the vibration of a shaft of the scroll-type compression portion is controllable steadily.

In accordance with the present invention, a bearing support may be formed in the housing. The second bearing may be supported by being installed in the bearing support.

The advantage is that the vibration of the rotary shaft steadily is controllable.

Other aspects and advantages of the invention become apparent from the following description, taken in conjunction with the accompanying drawings, illustrating the principles of the invention by way of example.

BRIEF DESCRIPTION OF THE DRAWINGS

The invention, together with the objects and advantages thereof, may best be understood by reference to the following description of the presently preferred embodiments together with the accompanying drawings in which.

DETAILED DESCRIPTION OF THE PREFERRED EMBODIMENTS

Figure 1:
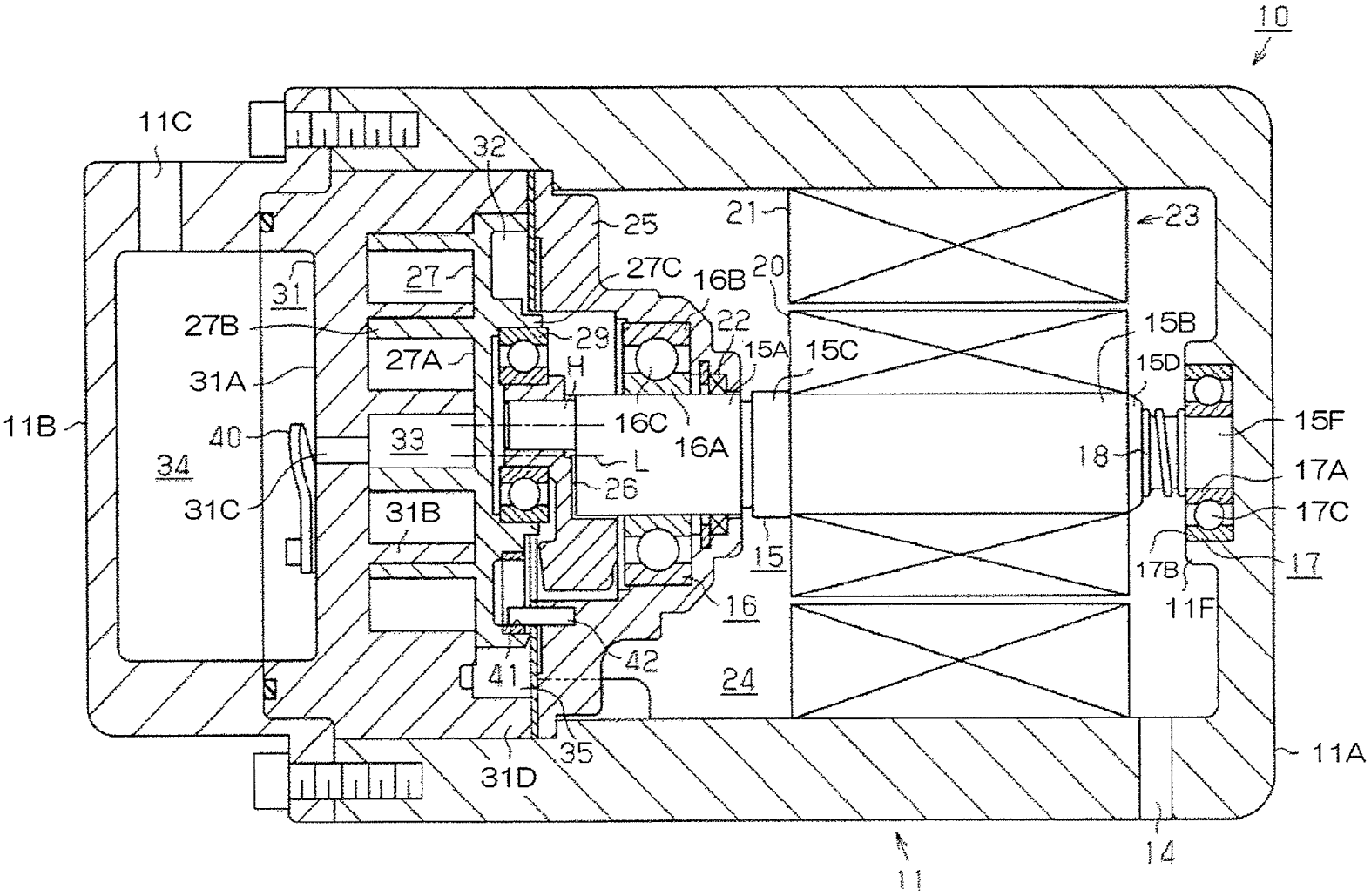
FIG. 1 is a sectional view of a scroll compressor according to an embodiment of the present invention.
Figure 2:
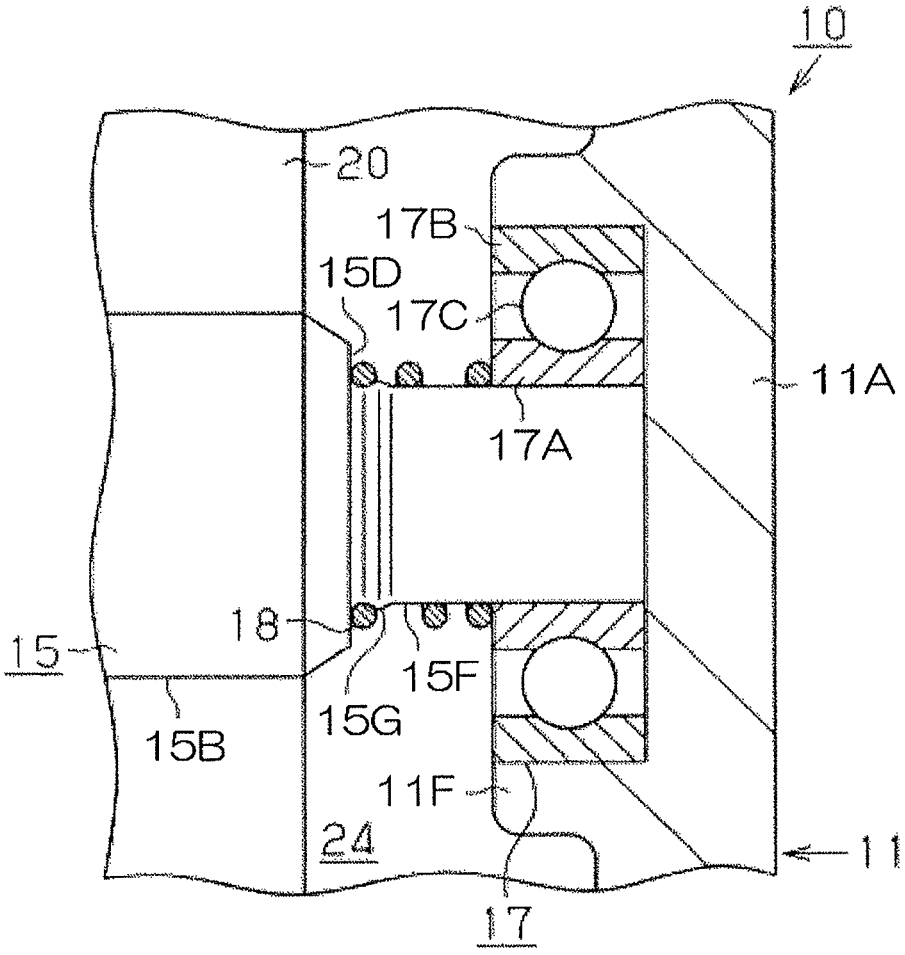
FIG. 2 is an enlarged fragmentary sectional view of a supporting structure of a rotary shaft.

The following describes an embodiment of the scroll compressor according to the compressor for vehicle of the present invention with reference to FIGS. 1 and 2.

Referring to FIG. 1, a housing 11 of a scroll compressor 10 has a first housing member 11A which is formed cylindrical with a bottom plate, and a second housing member 11B which is formed cylindrical with a lid. The first and second housing member 11A, 11B are fixed, for example, by bolts. The scroll compressor 10 is installed in a vehicle.

A suction port 14 for sucking fluid (refrigerant) compressed in the scroll compressor 10 is formed in the first housing member 11A. A rotary shaft 15 is located inside the first housing member 11A. One end portion of the rotary shaft 15 is rotatably supported by a first bearing 16. The other end portion of the rotary shaft 15 is rotatably supported by a second bearing 17. A rotor 20 in which a magnet is buried is integrally rotatably connected to the rotary shaft 15. A stator 21 is fixed surrounding the rotor 20 in an inner peripheral surface of the first housing member 11A. In the embodiment, an electric motor 23 has the rotary shaft 15, the rotor 20, and the stator 21.

A partition 25 which forms one part of the housing 11 is fixedly installed in the first housing 11A. A motor accommodation chamber 24 is defined in the housing 11 by the partition 25. The first bearing 16 which supports one end portion of the rotary shaft 15 is supported in an inner peripheral surface of the partition 25 (housing 11). A seal member 22 is installed in an inner periphery surface of the partition 25. The seal member 22 seals a space between outer periphery surface of the rotary shaft 15 and inner periphery surface of the partition 25.

At one end portion of the rotary shaft 15, an eccentric shaft H is supported at the position that deviated from a central axis L as the center of the rotary shaft 15. A bush 26 which is formed cylindrical with a lid is rotatably supported in the eccentric shaft H. A movable scroll 27 is rotatably supported at one end of the rotary shaft 15.

The movable scroll 27 has a discoidal movable side end wall 27A, a movable spiral wrap 27B which projects from the movable side end wall 27A to the second housing member 11B, and a cylindrical supporting tube portion 27C which projects from the movable side end wall 27A to the partition 25. A third bearing 29 is supported in the supporting tube portion 27C. The bush 26 is rotatably supported in the third bearing 29. The bush 26 revolves together with the eccentric shaft H around the center axis L by turning the rotary shaft 15.

A plurality of rotation blocking element 42 (only one element is shown in FIG. 1) are inserted and are fixed in the partition 25 which faces the movable side end wall 27A of the movable scroll 27. A revolution position restricting hole 41 in which the rotation blocking element 42 is inserted is formed in the movable side end wall 27A. The fixed scroll 31 is formed so as to face the movable scroll 27 at the side of the partition 25 where the end face of the second housing member 11B is located. The fixed scroll 31 has a integrally discoid fixed side end wall 31A and a fixed spiral wrap 31B which projects from the fixed side end wall 31A to the movable scroll 27. The movable spiral wrap 27B of the movable scroll 27 and the fixed spiral wrap 31B of the fixed scroll 31 mesh each other. A compression chamber 33 as a capacity changeable operating chamber is laid out between the movable scroll 27 and the fixed scroll 31.

The movable scroll 27 is provided between the partition 25 and the fixed scroll 31. A back pressure chamber 32 is laid out between the movable side end wall 27A of the movable scroll 27 and an inner periphery of the partition 25. A high-pressure gas is sucked in the back pressure chamber 32. The movable scroll 27 is pushed to the fixed scroll 31 along the axial direction of the rotary shaft 15 by the high-pressure gas. The back pressure chamber 32 is hermetically sealed by the seal member 22.

A suction chamber 35 for taking a refrigerant into a compression chamber 33 is laid out between an external wall 31D of the fixed scroll 31 and the outer periphery of the movable spiral wrap 27B of the movable scroll 27. A discharge chamber 34 is laid out between the fixed side end wall 31A of the fixed scroll 31 and the second housing member 11B. Additionally, in the fixed scroll 31, a discharge hole 31C connecting the compression chamber 33 and the discharge chamber 34 is formed at the middle of the fixed side end wall 31A.

A discharge valve 40 which forms a reed valve for gating a discharge hole 31C is laid out at the end face of the fixed side end wall 31A near the discharge chamber 34. A discharge port 11C is formed in the second housing member 11B, connecting the discharge port 11C to the suction port 14 by an external refrigerant circuit (unshown).

When the rotary shaft 15 is rotated by electrical power to the electric motor 23, the bush 26 revolves around the central axis L of the rotary shaft 15 through the eccentric shaft H. At this time, a line contact portion between the movable spiral wrap 27B and fixed spiral wrap 31B moves to the central position along the periphery surface of the fixed spiral wrap 31B. Then the capacity of the compression chamber 33 decreases. The refrigerant taken from the suction chamber 35 to the compression chamber 33 is compressed. The refrigerant compressed in the compression chamber 33 is discharged from the discharge hole 31C through a discharge valve 40 to the discharge chamber 34. A rotation of the movable scroll 27 is inhibited by the rotation blocking element 42. In the embodiment, a scroll-type compression portion is formed by the movable scroll 27 and fixed scroll 31.

Next, the supporting structure of the rotary shaft 15 is described.

With regard to the rotary shaft 15, the shaft 15 is inserted into the partition 25. A first shaft portion 15A is defined as the supporting portion of the eccentric shaft H. With regard to the rotary shaft 15, a holding portion 15B is defined as the portion to which the rotor 20 of the electric motor 23 is fixed. The holding portion 15B is formed with the same diameter as the first shaft portion 15A. With regard to the rotary shaft 15, a locking portion 15C is defined as the portion having a diameter greater than that of the holding portion 15B. The locking portion 15C is located near the first shaft portion 15A at the rotary shaft 15. The rotor 20 is prevented from pulling out toward the direction of the first shaft portion 15A by the locking portion 15C.

With regard to the rotary shaft 15, a spring supporting portion 15D is formed with a taper shape at the second bearing 17 side. The diameter of the taper becomes smaller from the holding portion 15B to the second bearing 17. With regard to the rotary shaft 15, a second shaft portion 15F is defined as the portion having a diameter smaller than that of the spring supporting portion 15D. The second shaft portion 15F is supported by the second bearing 17. The second bearing 17 is supported by a cylindrical bearing support 11F which is vertically arranged at the middle of the bottom of the first housing member 11A.

The first shaft portion 15A of the rotary shaft 15 is rotatably supported by the first bearing 16. The first shaft portion 15A is formed between the compression portion and the electric motor 23. The second shaft portion 15F is rotatably supported by the second bearing 17. The second shaft portion 15F is formed between the electric motor 23 and the first housing 11A. The first bearing 16 includes a first inner race 16A which integrally rotates with the first shaft portion 15A, a first outer race 16B which is fixedly pressed into the partition 25, and rolling elements 16C which are arranged between the first inner race 16A and the first outer race 16B. The second bearing 17 includes a second inner race 17A in which the second shaft portion 15F is inserted, a second outer race 17B which is inserted into the bearing support 11F, and rolling elements 17C which are arranged between the second inner race 17A and the second outer race 17B.

The first bearing 16 is supported by the partition 25, in the state that the first outer race 16B moves rarely to the axial direction of the rotary shaft 15 and that the first inner race 16A has a certain space for moving together with the rotary shaft 15 in the axial direction of the rotary shaft 15. The second bearing 17 is supported by the bearing support 11F wherein the second outer race 17B and the second inner race 17A have respectively a space for moving in the axial direction of the rotary shaft 15. Therefore, the rotary shaft 15 is supported by the second bearing 17 wherein the second shaft portion 15F is relatively movable with respect to the second inner race 17A in the axial direction. The rotary shaft 15 has a movable distance in the housing 11. The movable distance means that the first inner race 16A and the second inner race 17A are slidable relatively through the rolling element 16C, 17C against the first outer race 16B and the second outer race 17B into the direction of the rotary shaft 15.

As shown in FIG. 2, a protruding portion 15G which has a diameter a little larger as that of the second shaft portion 15F is formed in a circumferential direction around the whole second shaft portion 15F at a side near the spring supporting portion 15D of the second shaft portion 15F between the spring supporting portion 15D and the second bearing 17. A coil spring 18 is wound around in the second shaft portion 15F. The coil spring 18 is installed between the spring supporting portion 15D which faces to the axial direction of the rotary shaft 15 and the second inner race 17A in a compressed state. One end of the coil spring 18 is provided between the spring supporting portion 15D and the protruding portion 15G. The coil spring 18 is supported in contact with the spring supporting portion 15D. The other end of the coil spring 18 is supported in contact with the second inner race 17A.

The second inner race 17A is pressed toward the bearing support 11F by the return force of the coil spring 18 which is in a compressed state. A preload is provided to the coil spring 18. The rotary shaft 15 is pressed into the direction of the rotary shaft 15 by the preload. The preload is arbitrarily changeable by controlling the spring load or the amount of compression (the amount of expansion and contraction) of the coil spring 18.

Then, the following will explain the operation of the scroll compressor 10.

When the rotary shaft 15 is rotated by electric power to the electric motor 23 and the movable scroll 27 rotates around the fixed scroll 31, a refrigerant is compressed in the compression portion. Then, a vibration caused by the compression transfers to the axial direction along the rotary shaft 15. At this time, a preload is provided to the rotary shaft 15 by the coil spring 18, and the rotary shaft 15 remains preloaded. For this reason, the vibration of the rotary shaft 15 toward the axial direction by the vibration from the compression portion is suppressed. Additionally, it is possible to shift the peak of frequency of the rotary shaft 15 from the peak of frequency of the vehicle side vibration source (an engine, for instance) by reducing the preload which the coil spring 18 provides.

The scroll compressor 10 according to the embodiment offers the following advantages.

(1) With regard to the scroll compressor 10 in which both ends of the rotary shaft 15 are supported by the first bearing 16 and the second bearing 17, the compressed coil spring 18 is installed between the spring supporting portion 15D in the rotary shaft 15 and the second inner race 17A of the second bearing 17. Additionally, the preload is provided to the rotary shaft 15 by the return force when returning from the compressed condition of the coil spring 18, and the rotary shaft 15 remains tensioned. Therefore, even if a vibration by compression of the refrigerant in the compression portion is transferred in the axial direction of the rotary shaft 15, the vibration of the rotary shaft 15 is suppressed by the tension of the coil spring 18.

(2) When the compressing force of the coil spring 18 or the amount of spring load is increased, the preload provided to the rotary shaft 15 becomes bigger. It becomes more difficult to slide the rotary shaft 15 into the axial direction. In an opposite manner, when the compress amount of the coil spring 18 or the amount of spring load is decreased, the preload provided to the rotary shaft 15 becomes smaller, and it becomes easier to slide the rotary shaft 15 into the axial direction. Additionally, by reducing the compressing force of the coil spring 18 or the amount of spring load, it is possible to shift the peak of frequency when the rotary shaft 15 is vibrated. Therefore, the controllable region of the preload is shiftable by applying the coil spring 18. Additionally, the peak of frequency is shiftable when the rotary shaft 15 vibrates from the peak of frequency of the vehicle side vibration source, and common vibrations are controllable and resonance is avoided.

(3) The rotary shaft 15 is supported by the first bearing 16 and the second bearing 17. With regard to assembling, however, the second shaft portion 15F of the rotary shaft 15 is respectively movably installed against the second bearing 17 (the second inner race 17A). The coil spring 18 compresses the second inner race 17A against the bearing support 11 so that a backlash of the second inner race 17A is reduced.

(4) With regard to the rotary shaft 15, the protruding portion 15G is formed near the spring supporting portion 15D which abuts against one end of the coil spring 18. For this reason, if the coil spring 18 is extended in the axial direction of the rotary shaft 15 which is positioned in the vertical direction during assembling in the condition that the coil spring 18 is assembled to the rotary shaft 15, the coil spring 18 is prevented from falling from the rotary shaft 15 by being held at one end between the protruding portion 15G and one end of the coil spring 18. Therefore, on assembling the scroll compressor 10, when the rotary shaft 15 on which the coil spring 18 is assembled is transported, the coil spring 18 is prevented from falling from the rotary shaft 15, and the work efficiency is improved.

The coil spring 18 is installed at one end of the rotary shaft 15. For this reason, when the coil spring 18 also rotates with the rotary shaft 15, the refrigerant gas around the coil spring 18 is agitated by the rotation of the coil spring 18. Therefore, for instance, when an inverter for controlling the electric motor 23 is located near the coil spring 18 in the scroll compressor 10, the inverter is cooled by the agitation of the refrigerant gas by the coil spring 18.

(6) In the scroll compressor 10 which has the compression portion of the scroll-type, the vibration by the compression in the compression portion is easily transferred to the rotary shaft 15 through the fixed scroll 31 or the third bearing 29 or the like. Therefore, the vibration of the rotary shaft 15 is controlled by installing the coil spring 18 to the rotary shaft 15 of the scroll compressor 10. Consequently, resonance is reduced.

(7) The first bearing 16 is press-fitted in the partition 25. The second bearing 17 is inserted and supported by the bearing support 11F. Therefore, the rotary shaft 15 is relatively movable with respect to the second inner race 17A in the axial direction with being supported by the second bearing 17. For this reason, the rotary shaft 15 is movable into the axial direction. The vibration of the rotary shaft 15 is controlled by the compressing force of the coil spring 18.

The invention may be modified as follows.

The coil spring 18 may be installed between the inner race 16A of the first bearing 16 and a spring supporting portion formed at the rotary shaft 15 or the partition 25.

Figure 3:
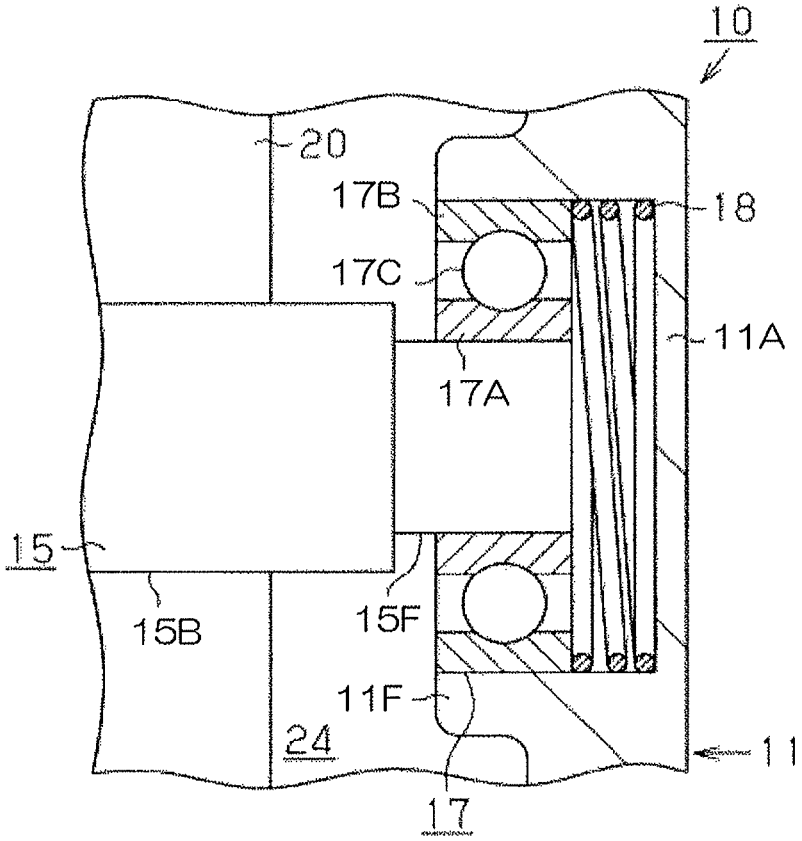
FIG. 3 is an enlarged fragmentary sectional view of a supporting structure of a rotary shaft according to an another embodiment.
Figure 4:
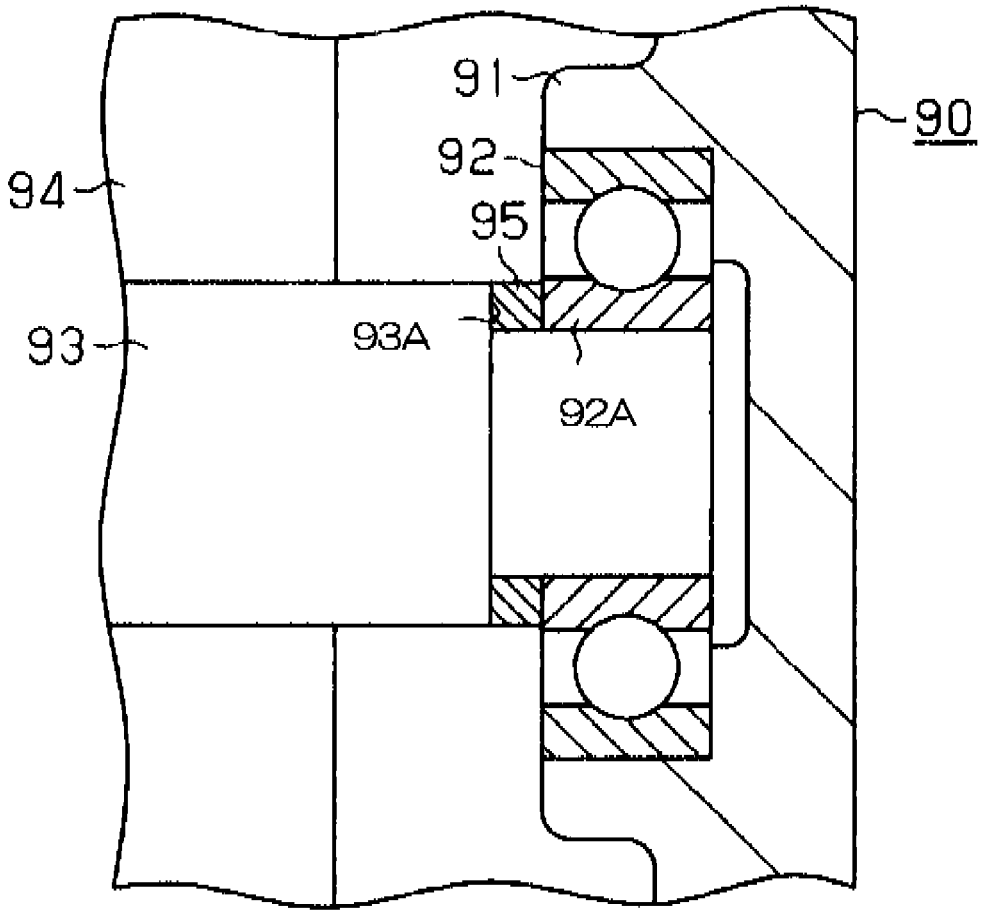
FIG. 4 (Prior Art)
FIG. 4 is an enlarged fragmentary sectional view according to a prior art.

The coil spring 18 is located between the spring supporting portion 15D of the rotary shaft 15 and the second inner race 17A of the second bearing 17 in the embodiment. But the invention is not limited to this structure. Referring to FIG. 3, the coil spring 18 is located in the space formed by the second outer race 17B and an inner periphery of the bearing support 11F. In this case, the second inner race 17A is fixed integrally with the second shaft portion 15F, and the second outer race 17B is relatively movable with respect to the bearing support 11F in the axial direction. The first housing member 11A opposing the second bearing 17 forms the spring supporting portion. In such a structure also, when the rotary shaft 15 vibrates, the vibration to the axial direction of the rotary shaft 15 is controlled by the compress of the coil spring 18 through the second outer race 17B.

The compressed coil spring 18 is installed between the second bearing 17 and the spring supporting portion 15D which faces the second bearing 17 in the axial direction of the rotary shaft 15 in the embodiment. But the invention is not limited to this structure. The coil spring 18 may be arranged between the first bearing 16 and the partition 25 which faces the first bearing 16 in the axial direction of the rotary shaft 15, for instance.

The compressed coil spring 18 is installed between the second bearing 17 and the spring supporting portion 15D which faces the second bearing 17 in the axial direction of the rotary shaft 15 in the embodiment. But the invention is not limited to this structure. An uncompressed coil spring 18 may be installed. The coil spring may be arranged between the first bearing 16 and the partition 25 which faces the first bearing 16 in the axial direction of the rotary shaft 15.

The protruding portion 15G formed in the rotary shaft 15 may be dispensable.

A compressor for vehicle is described as the scroll compressor applying supporting structure of the rotary shaft 15 shown in the embodiment. The compressor for vehicle which shows vibrations in the axial direction of the rotary shaft 15 is not limited to a scroll compressor. The compressor type may be a piston type or a vane type and the like.

The compressor driven by the electric motor 23 is described as the compressor for vehicle having a supporting structure of the rotary shaft 15 described in the embodiment. However the compressor may not be driven by an electric motor 23 but may be driven directly by a drive source of an engine and the like.

The engine is described as the vehicle side vibration source in the embodiment. However, the vehicle side vibration source is not limited to this.

What is claimed is:

1. A compressor for vehicle including a housing, the compressor comprising:

a compression portion located in the housing;

a rotary shaft connected with the compression portion at one end;

a motor driving the compression portion through the rotary shaft;

a motor accommodation chamber accommodating the motor;

a suction port formed in the housing and sucking fluid into the motor accommodation chamber; and a first shaft portion and a second shaft portion formed at both ends of the rotary shaft;

wherein the first shaft portion is formed between the compression portion and the motor, and is supported by a first bearing, wherein the second shaft portion is formed between the motor and the housing, and is supported by a second bearing, wherein a coil spring is wound around the second shaft portion so as to rotate with the second shaft portion, wherein the rotary shaft forms a spring supporting portion and the diameter of which is greater than that of the second shaft portion, wherein the second bearing includes an inner race, wherein the coil spring is installed between the inner race of the second bearing and the spring support portion of the rotary shaft, wherein the second shaft portion is relatively movable with respect to the inner race of the second bearing in the axial direction, and wherein the second shaft portion and the second bearing are disposed in the motor accommodation chamber and the suction port is opened to the motor accommodation chamber so as to face the second shaft portion.

2. The compressor for vehicle according to claim 1, wherein a protruding portion is formed between the second bearing and the spring support portion, wherein the protruding portion engages with the coil spring.

3. The compressor for vehicle according to claim 1, wherein the coil spring is installed in a compressed state.

4. The compressor for vehicle according to claim 3, wherein a protruding portion is formed between the second bearing and the spring support portion, wherein the protruding portion engages with the coil spring.

5. The compressor for vehicle according to claim 1, wherein the compression portion includes a plurality of scrolls.

6. The compressor for vehicle according to claim 1, wherein a bearing support is formed in the housing, wherein the second bearing is supported by being installed in the bearing support.

* * * * *